United States Patent [19]

Treptow et al.

[11] 4,219,400

[45] Aug. 26, 1980

[54] ELECTROLYSIS CELL

[75] Inventors: Wolfram Treptow, Ludwigshafen; Gerd Wunsch, Speyer; Volker Kiener, Weisenheim; Hermann Meyer, Frankenthal; Gotthard Csizi, Bad Durkheim, all of Fed. Rep. of Germany

[73] Assignee: BASF Aktiengesellschaft, Fed. Rep. of Germany

[21] Appl. No.: 948,160

[22] Filed: Oct. 3, 1978

Related U.S. Application Data

[63] Continuation of Ser. No. 804,460, Jun. 7, 1977, abandoned.

[30] Foreign Application Priority Data

Jul. 9, 1976 [DE] Fed. Rep. of Germany ..... 2630883

[51] Int. Cl.[2] ..... C25B 9/00

[52] U.S. Cl. ..... 204/266; 204/283

[58] Field of Search ..... 204/252, 282, 283, 295, 204/266

[56] References Cited

U.S. PATENT DOCUMENTS

| | | | |
|---|---|---|---|
| 3,392,103 | 7/1968 | Berger | 204/295 |
| 3,497,394 | 2/1970 | Berger | 204/294 X |
| 4,032,427 | 6/1977 | Kadija | 204/283 |
| 4,120,772 | 10/1978 | Kadija | 204/252 |
| 4,140,615 | 2/1979 | Kadija et al. | 204/283 X |

*Primary Examiner*—Charles F. Lefevour

*Attorney, Agent, or Firm*—Keil & Witherspoon

[57] ABSTRACT

In an electrolysis cell with anodes and cathodes which are provided with openings, the cathode chamber is separated from the anode chamber by a diaphragm. The latter consists of a porous layer of oxides or oxidic compounds of the elements of sub-group 4B of the periodic table, of aluminum, of the rare earths or of chromium. The diaphragm is applied to that side of one of the electrodes which faces the counter-electrode.

6 Claims, 2 Drawing Figures

ELECTROLYSIS CELL

Figure 1:
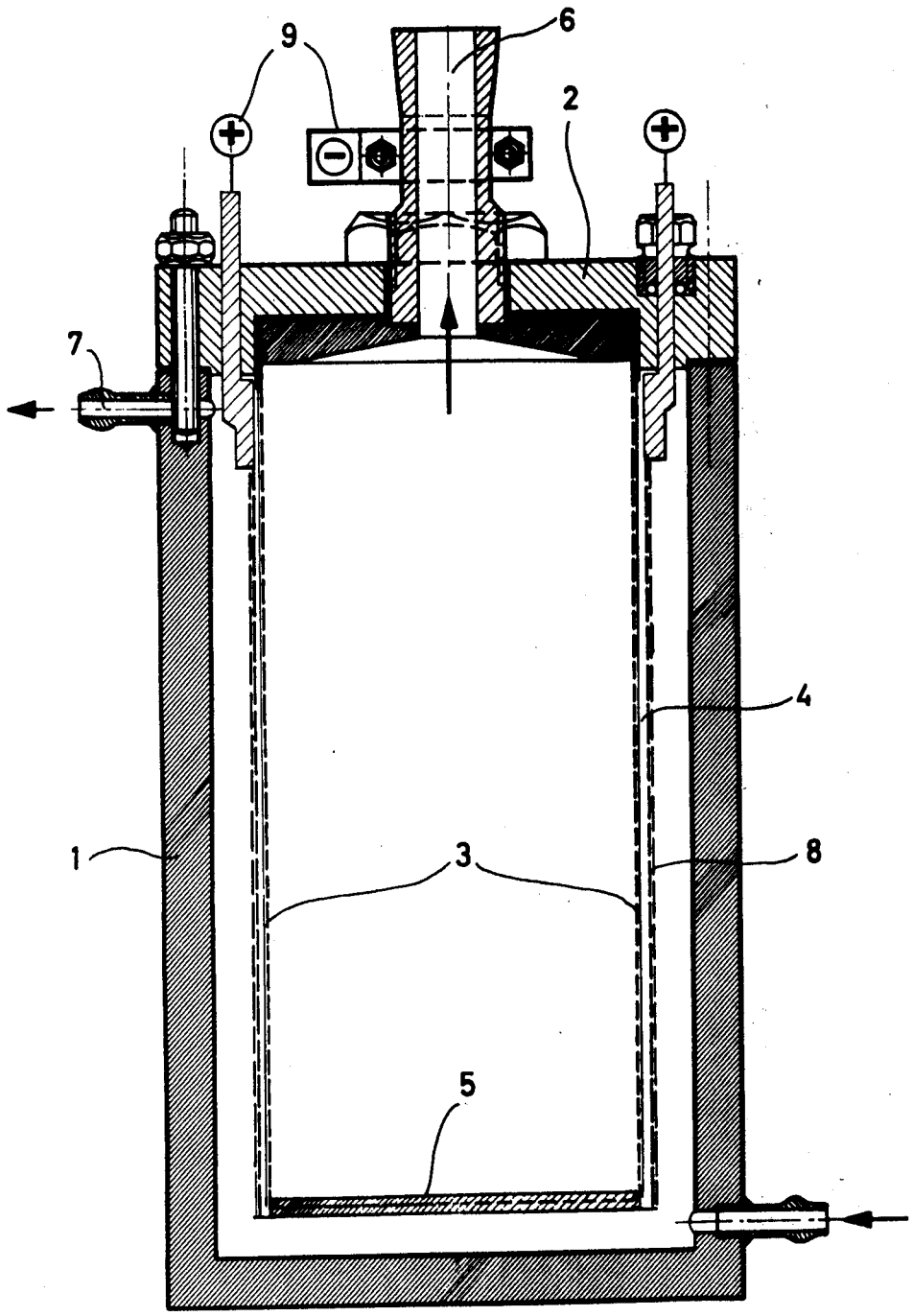

This is a continuation, of application Ser. No. 804,460 filed June 7, 1977, now abandoned.

The present invention relates to an electrochemical cell which contains a dimensionally stable diaphragm of inorganic high-melting compounds and which is manufactured by the plasma-spraying process or flame-spraying process.

In compartmented cells for electrochemical syntheses, diaphragms are frequently used as the partitions between the cathode chamber and the anode chamber. In the electrolysis of alkali metal chlorides, in particular, asbestos diaphragms have been used for decades. The function of the diaphragms is effectively to separate the cathode and anolyte, in particular in such a way that the catholyte has a pH>12 and the anolyte has a pH of from 3.5 to 5.5. The electrolyte, which contains about 320 g/l of sodium chloride, is forced through the diaphragm, after having been depleted at the anode, with evolution of chlorine, and is withdrawn from the catholyte chamber, with an NaOH content of from 12 to 15% by weight. The diaphragm must ensure good gas separation between the chlorine and the hydrogen evolved in the catholyte chamber and must substantially prevent the diffusion of $OH^-$ions from the catholyte chamber into the anolyte chamber, while being sufficiently permeable to the anolyte. However, asbestos diaphragms swell steadily during the electrolysis, so that the distance between the electrodes increases and the cell potential rises undesirably. As long as graphite anodes were used in diaphragm cells, the rate at which the graphite was worn away approximately kept pace with the rate at which the diaphragm swelled, so that when the graphite anodes were replaced, it was also possible to replace the diaphragm. As a result of the introduction of dimensionally stable titanium-based anodes, which have a substantially longer life, problems arise because the replacement of the diaphragms and of the anodes can no longer be carried out in one and the same step. Further problems result from the fact that as the diaphragms swell, they exert increasing pressure on the electrodes. In order to improve the properties of these asbestos diaphragms and in particular to prevent swelling, attempts have been made to encase asbestos fibers in plastics (Netherlands Laid-Open Application 7,400,587). The use of plastics with ion-exchange properties for the said purpose has also been disclosed (U.S. Pat. Nos. 3,853,720 and 3,853,721). Diaphragms manufactured from plastic fibers, above all from polytetrafluoroethylene, with or without additives, has equally been disclosed (Belgian Pat. Nos. 817,677 and 817,676, Japanese Laid-Open Application 9,086-298 and Belgian Pat. No. 793,078). According to Belgian Pat. No. 822,488, diaphragms of certain oxide fibers which are difficult to obtain, eg. of $ZrO_2$, may also be used.

The starting material for the manufacture of these diaphragms is always a suspension of the fibers, which is then applied to the cathode grid and is subsequently dried. Disadvantages of this process are that the method of applying these diaphragms is difficult and that in order to achieve high current efficiencies, the layers must be at least about 1,000 μm thick. In turn, the fact that the layer is thick causes increased energy consumption during electrolysis. The production of the diaphragm requires several steps, namely fibrillating the starting material, suspending the fibers, adding polymers or the like, applying the suspension to a carrier, and drying the product. The requisite uniform thickness of the diaphragm over large areas is also not a simple matter to reproduce.

It is an object of the present invention to provide electrolysis cells with diaphragms in which these disadvantages are avoided.

We have found that this object is achieved by an electrolysis cell with cathodes and anodes provided with openings, in which the cathode chamber and anode chamber are separated from one another by a diaphragm, wherein a porous layer containing at least one inorganic oxide or oxidic compound of the elements of sub-group 4 of the periodic table and/or of aluminum and/or of the rare earths and/or of chromium, the layer having been applied by the plasma-spraying process or flame-spraying process to that side of one of the electrodes which faces the counter-electrode, is used as the diaphragm.

Surprisingly, the oxides and oxidic compounds applied in this manner adhere well to the metal electrodes which serve as the carrier and do not break even if the carrier is severely distorted. The layers may be from 50 to 500 μm thick, preferably from 100 to 150 μm thick. The pore volume is from 10% to 60% and the pore size from 0.1 to 15 μm. Both the pore volume and the pore size may be varied in the conventional manner by choice of the flame-spraying or plasma-spraying conditions. Oxide powders with particle sizes of from 10 μm to 1 mm are used as the starting material, particle sizes of from 50 to 200 μm being preferred.

The advantage of the diaphragms resides in their complete dimensional stability, the low thickness of the layers and the simple method by which they may be applied to the carriers, which makes it possible reproducibly to form layers of very uniform thickness. Thus, for a 100 μm thick layer, the maximum variation in thickness is only ±5 μm. Large surfaces can be dealt with particularly simply, in very little time, by means of automated plasma-spraying units. It is no longer necessary, as was the case in the prior art, the fibrillate the diaphragm material, suspend it and apply it to the carrier, in several process steps; instead, the diaphragm can be produced in one step, from the carrier and the oxide powder.

In principle, all electrically non-conductive inorganic oxides which can be processed by flame-spraying or plasma-spraying may be used for the diaphragms in the electrolysis cell according to the invention. Such oxides are those of the elements of sub-group 4 of the periodic table, ie. the oxides of titanium, zirconium and hafnium, as well as aluminum oxide, chromium oxide and the rare earth oxides.

The said oxides may be employed individually or as mixtures in any desired ratios. To increase the flexibility and adhesion of the oxidic diaphragm layers on the metallic carriers, it is advantageous to add alkali metal oxides and alkaline earth metal oxides, as well as the oxides of molybdenum, tungsten, vanadium, nickel, tantalum, gallium, indium, tin and silicon, to the said oxides. These latter oxides may be added to the first-mentioned oxides in such an amount that, per mole of the first-mentioned oxides, not more than 1 mole of the latter oxides is present. However, significant improvements are achieved even by adding smaller amounts.

The diaphragm layer may be applied to the metallic carriers by various methods. The carrier at the same time acts as an electrode, preferably as the cathode. The simplest carrier is steel wire cloth, with holes of, for example, from 50 to 100 μm diameter. The wire gauge is of the same order of magnitude. Woven wire cloth, perforated metal sheets and expanded metal sheets may also be used as the carrier. Using these materials, the achievable strength of the diaphragm is greater than with simple steel netting, which has to be stretched over a special coarse-mesh carrier to increase the stability. The diameter of the holes of the perforated metal sheets or expanded metal sheets is from 10 to 200 μm, preferably from 60 to 80 μm, while the thickness of these sheets may be from 100 to 2,000 μm, preferably from 500 to 1,000 μm. The open area is from 6 to 40% of the total area. Metal sheets with conical holes so arranged that the narrow orifice of the hole is on the oxide-coated side, in order to facilitate hydrogen entering the catholyte, are preferred. The diaphragm-screened side should in addition be structured to ensure good adhesion of the diaphragm layer. In contrast, the uncoated side of the cathode is advantageously smooth. In addition to circular and triangular holes, and the like, slots, above all, are of advantage. Holes of from 10 to 100 μm width and from 500μ to 3 mm length may be provided in the case of metal sheets of the above thicknesses, and the open area (measured on the narrow side of the holes) should be from 6 to 30% if the cathode is to possess good stability. Slots which are from 40 to 50 μm wide and from 1 to 1.8 mm long represent an optimum.

Woven wire cloth with openings having a width of from 5 to 200 μm is very suitable for receiving the diaphragm layer and expelling the hydrogen on the uncoated side during the electrolysis. Widths of from 50 to 100 μm represent the optimum. The open area is from 10 to 60%. The nets, made, for example, from steel or nickel, ensure good dissipation of heat during the plasma-spraying process, and because of their markedly structured surface the oxide layer adheres particularly well. The coating efficiency is substantially greater on woven wire cloth than on perforated metal sheets or simple wire cloth, so that the rate of coating can be increased. All forms of cathodes can be coated by the process according to the invention. Both large planar surfaces and cylindrical cathodes for trough cells can be manufactured easily, in a ready-to-use form and in a single step, by automatic movement of the plasma torch or of the object being coated.

If the carrier acts as the anode, titanium in particular is used as the metallic material of construction, whilst if it acts as the cathode, nickel, iron and iron alloys, especially corrosion-resistant steels, may in particular be used.

To produce particularly firmly adhering oxide layers it is advantageous, before applying the oxides to the carrier, first to coat the latter with an intermediate layer of an electrically conductive material, again by means of the flame-spraying process or plasma-spraying process; advantageously, this intermediate layer is also porous, with a pore volume of from 10 to 60%. The thickness of these intermediate layers is as a rule from 0.5 to 1 mm. Suitable materials for these intermediate layers are the materials also employed to produce cathodes, eg. V2A steel or nickel.

Figure 2:
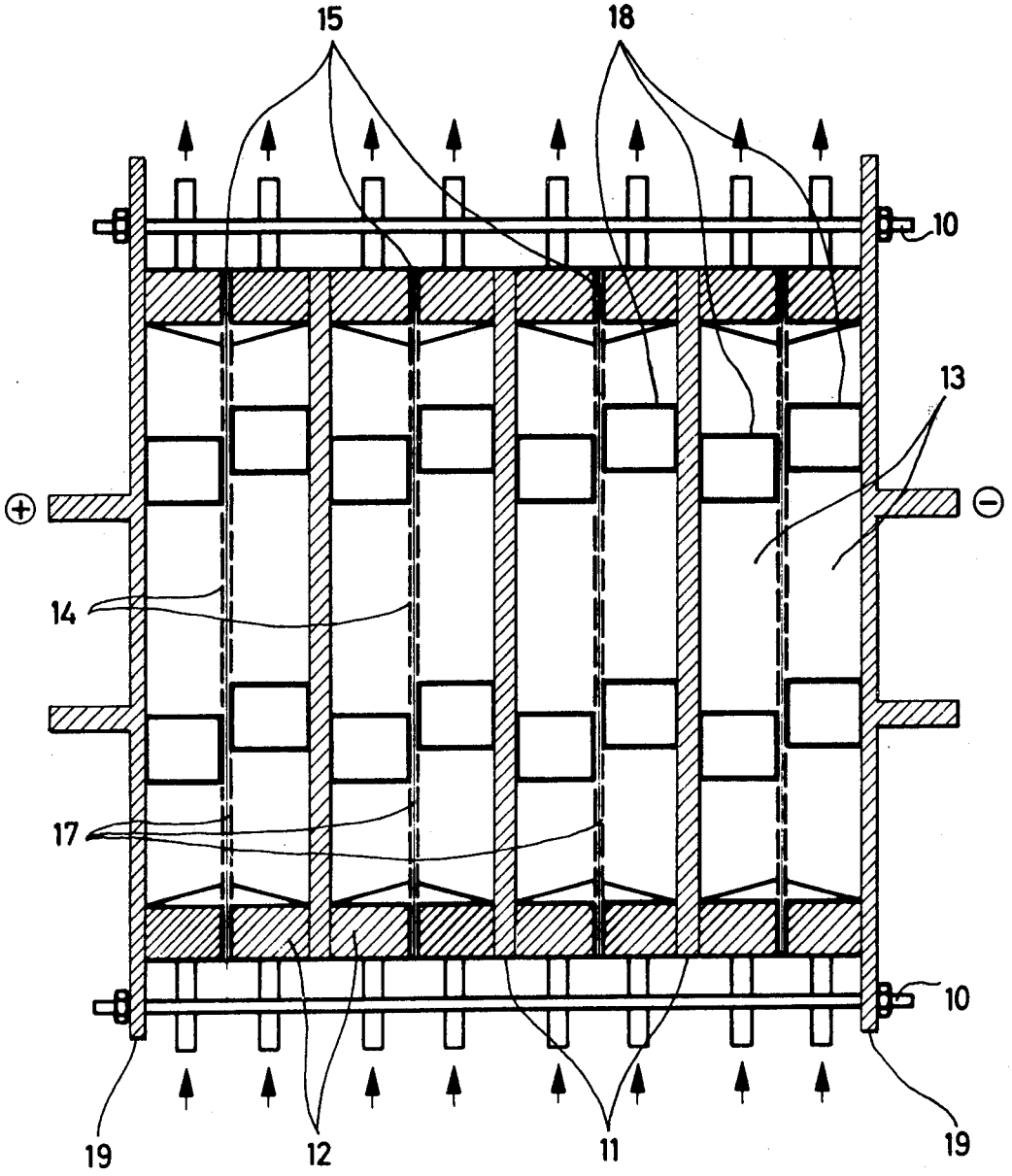

The electrolysis cell according to the invention is explained in more detail below, with reference to FIGS. 1 and 2. FIG. 1 shows a cell with monopolar electrodes and FIG. 2 a filterpress-like cell with a bipolar arrangement of the electrodes. The monopolar embodiment (see FIG. 1) advantageously comprises a trough (1) which contains the brine. The cylindrical cathode nets (3), provided with the diaphragm (4), are attached to the lid (2). The lower part of the cylindrical cathodes is closed off by a rubber-coated steel baseplate or a rubber baseplate (5). The sodium hydroxide solution and hydrogen are removed from the cylindrical chamber through the nozzle (6). Chlorine is discharged from the brine chamber through the nozzle (7). An activated titanium expanded metal anode (8) surrounds the diaphragm as closely as possible, in order to minimize voltage losses. The power supply (9) for both anode and cathode is provided through the lid of the cell. Individual parts of the cylinder can readily be replaced.

The bipolar electrolysis cell (see FIG. 2) contains bipolar planar electrodes (11) separated from one another by frames (12). Electrolyte chambers (13) are located behind the cathodes and anodes, to facilitate gas discharge. The titanium expanded metal anode (14) rests on the diaphragm (15). This makes it possible to have an extremely small distance between the anode and the cathode, and hence to achieve the optimum cell potential. The cathode nets (17) and the titanium expanded metal anode (14) are connected by spacers (18), respectively made of the same material, to the current feedplates (19) and the bipolar electrodes (11). The bipolar electrodes (11), made of steel or nickel on the cathode side and of titanium on the anode side, are welded together, explosion-plated or, in the simplest case, pressed against one another in the cell. The cell is held together by the bolts (10).

EXAMPLE 1

An electron beam-perforated steel sheet of size 100×170×1 mm is degreased and sand-blasted on the side which is to be provided with the diaphragm layer. The average hole diameter is 100 μm and the hole spacing is 400 μm, corresponding to an open area of 6.5% of the total area. After sand-blasting the sheet, aluminum oxide of particle size 110 μm is sprayed, by means of a nitrogen plasma which contains 10% by volume of hydrogen, onto one side of the steel sheet, under a constant torch power of 40 kW, with a powder feed of 1,000 $cm^3/h$. The layer produced is 130 μm thick, with a pore volume of 40% and a pore size of about 10 μm.

The diaphragm has a permeability of about 25 $l/m^2.h$, measured on a solution containing 320 g/l of NaCl in $H_2O$, at 80° C.

The electron beam-perforated steel sheet, carrying the $Al_2O_3$ layer, is made the cathode in a filterpress diaphragm cell, whilst a titanium expanded metal anode, activated with ruthenium dioxide, rests directly on the diaphragm.

Using a current density of 20 $A/dm^2$, an average cell potential of 3.5 volts is measured. The brine throughput is 250 $ml/dm^2h$ and the current efficiency, based on NaOH, is from 96 to 97%. The chlorine gas is 99.1% pure. The final concentration of the alkali is 9.6% by weight, with a NaCl content of 146 g/l.

EXAMPLE 2

A 2 $dm^2$ woven nickel wire cloth, 2.0 mm thick, with 80 μm wide orifices, is coated on one side with zirconium dioxide which contains 3% by weight of CaO. The zirconium dioxide powder, of 90 μm particle size, is applied by means of an argon plasma under a constant torch power of 45 kW, with a powder feed of 1,250 $cm^3/h$. The layer produced is 120 μm thick, with a pore volume of 30% and a pore size of about 10 μm.

The diaphragm thus obtained is fitted into a diaphragm cell as described in Example 1.

During the electrolysis, the sodium hydroxide solution is produced at a concentration of 10.3% by weight. The current efficiency, based on NaOH, is 95.5%. The chlorine gas obtained is 99.0% pure. The cell potential is found to be 3.45 volts. At a throughput of 455 ml per hour of brine through the diaphragm, the NaCl concentration is lowered from 320 g/l to 128.5 g/l.

EXAMPLE 3

A perforated steel sheet of size 1 $m^2$ is coated, by means of a plasma torch, with a 110 μm thick layer consisting of titanium dioxide. A pure $N_2$ plasma is used under a constant torch power of 50 kW, with a powder feed of 1,500 $cm^3$/h. The particle size of the titanium dioxide powder is 110 μm. Before applying the diaphragm layer, the perforated metal sheet is degreased, and blasted with aluminum oxide powder. The holes are 80 μm wide and 1.5 mm long.

The electrolysis of NaCl (current density: 2 kA/$m^2$) gives an 8.4% strength by weight sodium hydroxide solution, with a current efficiency of 97%. The chlorine gas is 99.3% pure. The cell potential is 3.4 volts. The throughput of NaCl solution, containing 320 g/l of NaCl, is 29 l/h.$m^2$. The depletion in NaCl is about 151 g/l (the final concentration of the brine being about 169 g/l of NaCl).

EXAMPLE 4

An alkali metal chloride electrolysis is carried out under industrial conditions in a monopolar electrolysis cell which contains cylindrical cathode nets of corrosion-resistant steel (V2A steel) and activated titanium anodes. The cathode cylinder is 1,000 mm in height and has a diameter of 318 mm (see FIG. 1). Before being fitted into the trough cell, the cathode cylinder is provided, by plasma spraying, with a diaphragm of inorganic oxides or oxidic compounds, the diaphragm comprising a 140 μm thick layer. A number of diaphragms, composed of different mixtures of the powders used, are tested. The results of the alkali metal chloride electrolysis and the ratios in which the oxides and oxidic compounds are mixed are shown in the Table which follows.

The current density is 2 kA/$dm^2$ and the initial brine concentration is 320 g/l of NaCl, at 80° C. The method of operation gives an alkali solution containing 150–160 g/l of NaCl.

The oxide mixtures are applied to the cathodes with a torch power of 30–45 kW, the distance of the torch from the workpiece being from 150 to 200 mm. The torch travels at 60 m/min.

| Qxide mixture fed into the plasma torch | Relative proportions [% by weight] | Current efficiency [%] | Concentration of NaOH [% by weight] | Purity of $Cl_2$ [%] | Cell potential | Plasma gas |
|---|---|---|---|---|---|---|
| $Al_2O_3/TiO_2$ | 97/ 3 | 96 | 13.2 | 99.1 | 3.2 | $N_2/H_2$ |
| $ZrO_2/CaO$ | 90/10 | 96 | 12.5 | 99.1 | 3.3 | Ar |
| $ZrO_2/MgO$ | 95/ 5 | 96.5 | 12.0 | 99.2 | 3.3 | Ar |
| $Al_2O_3/TiO_2$ | 50/50 | 97 | 12.0 | 99.3 | 3.3 | $N_2/H_2$ |
| $TiO_2/La_2O_3$ | 50/50 | 95 | 14.7 | 99.3 | 3.4 | $N_2/H_2$ |
| $Cr_2O_3/CaO \cdot SiO_2$ | 56/44 | 94.5 | 13.1 | 99.1 | 3.4 | $Ar/H_2$ |
| $Cr_2O_3/CaO$ | 73/27 | 96.5 | 12.5 | 99.1 | 3.5 | Ar |
| $Al_2O_3/MoO_3$ | 98/ 2 | 96 | 12.5 | 99.1 | 3.2 | Ar |
| $Al_2O_3WO_3$ | 96/ 4 | 95.5 | 12.5 | 99.0 | 3.2 | Ar |
| $ZrO_2/V_2O_5$ | 99/ 1 | 95.5 | 13.0 | .1 | 3.4 | Ar |
| $Cr_2O_3/Nb_2O_5$ | 90/10 | 95.5 | 13.0 | 99.2 | 3.4 | Ar |
| $HfO_2/Ta_2O_5$ | 90/10 | 96 | 11.8 | 99.2 | 3.3 | $N_2/H_2$ |
| $TiO_2/Ca_2O_3$ | 95/ 5 | 96 | 11.5 | 99.2 | 3.3 | $Ar/H_2$ |
| $TiO_2/In_2O_3$ | 97/ 3 | 96 | 10.9 | 99.3 | 3.3 | $Ar/H_2$ |
| $Al_2O_3/SnO_2$ | 98/ 2 | 96.5 | 11.0 | 99.3 | 3.3 | $N_2/H_2$ |
| $Cr_2O_3/SiO_2$ | 94/ 6 | 96 | 13.6 | 99.3 | 3.5 | $N_2/H_2$ |
| $TiO_2/BaO$ | 34/66 | 96 | 13.6 | 99.1 | 3.5 | $Ar/H_2$ |
| $Al_2O_3/Na_2O$ | 97/ 3 | 95 | 12.0 | 99.2 | 3.3 | $N_2/H_2$ |

We claim:

1. An electrolysis cell with metal cathodes and anodes provided with openings, in which the cathode chamber and anode chamber are separated from one another by a diaphragm, wherein a porous layer, which is from 50 to 500 μm thick and contains at least one inorganic oxide or oxidic compound of an element of sub-group 4B of the periodic table, of aluminum, of the rare earths and of chromium, the layer having been applied by the plasma-spraying process or flame-spraying process to that side of one of the metal electrodes which faces the counter-electrode, is used as the diaphragm.

2. An electrolysis cell as claimed in claim 1, wherein the electrode to which the diaphragm is applied consists of wire cloth, perforated metal sheet or expanded metal.

3. An electrolysis cell as claimed in claim 1 or 2, wherein the diaphragm consists of a layer which is from 50 to 500 μm thick, preferably from 100 to 150 μm thick.

4. An electrolysis cell as claimed in any of claims 1 to 3, wherein the diaphragm additionally contains at least one of the following oxides: alkali metal oxides, alkaline earth metal oxides as the oxides of molybdenum, tungsten, vanadium, niobium, tantalum, gallium, indium, tin and silicon.

5. An electrolysis cell as claimed in claim 4, wherein the content of the additionally present oxides does not exceed 1 mole per mole of oxides of the elements of sub-group 4B of the periodic table of aluminum, of the rare earths and of chromium.

6. An electrolysis cell as claimed in claim 1, wherein the electrode to which said porous layer is applied is the cathode, the metal of which is selected from the group consisting of nickel, iron and steel.

* * * * *